US010258110B2

(12) United States Patent
Sussmann

(10) Patent No.: US 10,258,110 B2
(45) Date of Patent: Apr. 16, 2019

(54) SHOE, IN PARTICULAR SPORTS SHOE

(71) Applicant: PUMA SE, Herzogenaurach (DE)

(72) Inventor: Reinhold Sussmann, Scheinfeld (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 15/735,137

(22) PCT Filed: May 11, 2016

(86) PCT No.: PCT/EP2016/000770
§ 371 (c)(1),
(2) Date: Dec. 8, 2017

(87) PCT Pub. No.: WO2017/194070
PCT Pub. Date: Nov. 16, 2017

(65) Prior Publication Data

US 2018/0228251 A1 Aug. 16, 2018

(51) Int. Cl.

| | |
|---|---|
| ***A42B 1/10*** | (2006.01) |
| ***A43C 15/14*** | (2006.01) |
| ***A43B 13/18*** | (2006.01) |
| ***A43C 15/16*** | (2006.01) |
| ***A43B 5/00*** | (2006.01) |
| ***A43B 5/02*** | (2006.01) |

(52) U.S. Cl.
CPC ..... *A43C 15/14* (2013.01); *A43B 5/001* (2013.01); *A43B 5/025* (2013.01); *A43B 13/181* (2013.01); *A43C 15/168* (2013.01)

(58) Field of Classification Search
CPC ..... A43C 15/14; A43B 5/001; A43B 5/025; A43B 13/181; A43B 13/12; A43B 15/168
USPC ..... 36/102, 28, 30 R
See application file for complete search history.

(56) References Cited

U.S. PATENT DOCUMENTS

| | | | | |
|---|---|---|---|---|
| 429,429 A * | 6/1890 | Eckhardt | A43C 15/161 | 36/3 B |
| 3,757,774 A * | 9/1973 | Hatuno | A43B 3/128 | 36/141 |
| 5,367,791 A * | 11/1994 | Gross | A43B 13/181 | 36/25 R |

(Continued)

FOREIGN PATENT DOCUMENTS

| | | |
|---|---|---|
| JP | H01-285202 A | 11/1989 |
| JP | 2005-532845 A | 11/2005 |

(Continued)

*Primary Examiner* — Timothy K Trieu
(74) *Attorney, Agent, or Firm* — Lucas & Mercanti, LLP

(57) ABSTRACT

A shoe, in particular a sports shoe, having a sole connected to a shoe upper. The sole includes: a first sole part having a bottom plate arranged with a number of first damping elements; a second sole part having a cover plate arranged with a number of second damping elements; a connecting part having a number of interconnected plug connections. Each plug connection has a first plug directed downward and a second plug directed upward. The first plug engages in a section of the first damping element, and the second plug engages in a section of the second damping element. At least a number of the first plugs extends through an opening in the bottom plate so that, when the sole is deformed by the weight of the wearer, the first plug protrudes from the lower surface of the sole further than without application of the weight of the wearer.

31 Claims, 3 Drawing Sheets

(56) References Cited

U.S. PATENT DOCUMENTS

| | | | | |
|---|---|---|---|---|
| 7,153,560 | B2 | 12/2006 | Hofmann | |
| 8,607,477 | B2 | 12/2013 | Amark | |
| 2005/0268490 | A1* | 12/2005 | Foxen | A43B 7/1425 36/28 |
| 2005/0268491 | A1* | 12/2005 | McDonald | A43B 1/0063 36/28 |
| 2008/0263894 | A1 | 10/2008 | Nakano | |
| 2010/0077635 | A1 | 4/2010 | Baucom | |
| 2015/0196082 | A1* | 7/2015 | Van Atta | A43B 7/00 36/103 |
| 2015/0196087 | A1 | 7/2015 | Meschter | |
| 2016/0066648 | A1* | 3/2016 | Lazarchik | A43B 3/108 36/30 R |

FOREIGN PATENT DOCUMENTS

| | | | |
|---|---|---|---|
| JP | 2011-512985 | A | 4/2011 |
| WO | 0170062 | A2 | 9/2001 |
| WO | 03092423 | A1 | 11/2003 |
| WO | 2009110622 | A1 | 9/2009 |
| WO | 2010/057207 | A2 | 5/2010 |

* cited by examiner

SHOE, IN PARTICULAR SPORTS SHOE

The present application is a 371 of International application PCT/EP2016/000770, filed May 11, 2016, the priority of this application is hereby claimed and this application is incorporated herein by reference.

BACKGROUND OF THE INVENTION

The invention relates to a shoe, in particular to a sports shoe, which has a sole connected to a shoe upper.

Shoes of the generic kind are well known in the state of the art. Here, a demand exists to allow as good as possible to adapt the sports shoe—especially if used as sport shoe—to individual needs; this applies especially with respect to the spring and damping behaviour of the shoe.

Furthermore, the shoe should have during its use as much as possible constant and unchanging properties over the time.

A further aspect which becomes increasing important is the aspect of recycling. Here it is desired to design a generic shoe so that it can be depolluted correctly sorted.

Furthermore, for specific application it is required, for example the use as a golf shoe should be mentioned, that the shoe has a proper hold especially on a lawn at special load conditions; insofar a cleat effect is desired, especially when the shoe is charged with a pulsed load by the weight and mass force respectively of the user of the shoe. When such a strong pulsed load does not occurs a cleat effect is often however not desired. Accordingly, a solution is searched which provides the mentioned cleat effect and thus an improved hold of the shoe on the ground if necessary, wherein apart from that the shoe has however normal properties (without cleat effect). Insofar a shoe with cleat function is desired under special load conditions ("Grip on demand"). This functionality of the shoe should be primary be given at once under consideration of the above mentioned demands.

SUMMARY OF THE INVENTION

It is the object of the invention to further develop a shoe of the above mentioned kind so that it can be adapted to individual demands in an easy manner and thus cost-effective. Furthermore, the waste disposal of the shoe should be possible in an easy manner. A further important aspect of the present invention is that it should be possible to give the shoe an improved hold on the ground; insofar the grip of the sole of the shoe on the ground should be improved when the shoe is charged with strong loads.

The solution of this object according to the invention is characterized in that the sole of the shoe comprises:

- a first sole part which has a bottom plate, wherein a number of first damping elements which extend in direction of loading is arranged on the bottom plate;
- a second sole part which has a cover plate, wherein a number of second damping elements which extend in direction of loading is arranged on the cover plate;
- a connecting part which comprises a number of plug connections which are connected with another, wherein each plug connection comprise a first plug which extends downwards in the direction of loading and a second plug which extends upwards in the direction of loading, wherein the first plug is designed to engage in a section of the first damping element and wherein the second plug is designed to engage in a section of the second damping element, wherein at least a number of the downwards directed first plugs extends through an opening in the bottom plate in such a manner that the first plug at a deformation of the sole in direction of loading due to the weight of the wearer protrudes from the lower surface of the sole further than without application of the weight of the wearer.

Namely, this has to be understood in that manner that the first plug protrudes and leaves respectively by a certain amount the envelope of the bottom side of the sole (surface of the sole) at a respective strong charging of the shoe with the weight and mass force respectively of the wearer and so fulfils a cleat or stud function.

The first damping elements are preferably formed at the bottom plate in one piece and/or the second damping elements are preferably formed at the cover plate in one piece.

The first damping elements are preferably designed as hollow bodies and comprise in its upper end region a hollow-cylindrical section; correspondingly, the second damping elements are preferably designed as hollow bodies and comprise in its lower end region a hollow-cylindrical section.

The first plug is thereby preferably designed to frictionally engage into the hollow-cylindrical section of the first damping element respectively the second plug is preferably designed to frictionally engage into the hollow-cylindrical section of the second damping element.

The first plug and the inner diameter of the hollow-cylindrical section of the first damping element are preferably tolerated to another in such a manner that in the mounted state the first plug and the hollow-cylindrical section are arranged to another with press fit; respectively it can be provided that the second plug and the inner diameter of the hollow-cylindrical section of the second damping element are tolerated to another in such a manner that in the mounted state the second plug and the hollow-cylindrical section are arranged to another with press fit. In this case only a frictional connection of the sole parts can be considered as the case may be; another provision of a connection (especially a gluing) of the sole parts can so be prevented beneficially even though such a measure is not excluded.

The first sole part can be surrounded by an edge which extends laterally upwards. By doing so the first sole part obtains a shell-shaped structure.

The second sole part can thereby have such an extension that is covers the rear sole region and leaves the front sole region uncovered. In this case it can furthermore be provided that the connection part comprises plug connections only in that region which is covered by the second sole part. The connecting part can comprise at least one flat footrest in that region which is not covered by the second sole part.

The first damping elements consist preferably of two partial hollow bodies which are connected with another by a connection section which extends substantially perpendicular to the direction of loading, wherein one of the partial hollow bodies is formed by the hollow-cylindrical section in the upper region of the damping element. Thereby especially the outer dimensions of the upper partial hollow body are smaller than the outer dimensions of the bottom partial hollow body.

Correspondingly, is can be provided that the second damping elements consist of two partial hollow bodies which are connected with another by a connection section which extends substantially perpendicular to the direction of loading, wherein one of the partial hollow bodies is formed by the hollow-cylindrical section in the lower region of the damping element, wherein especially the outer dimensions of the lower partial hollow body are smaller than the outer dimensions of the upper partial hollow body.

The plug connections of the connecting part can be connected with another by a plurality of bar-shaped or rod-shaped connection rods. Thereby it is specifically provided that two adjacent plug connections of the connecting part are connected with each one connection rod.

The first sole part including all damping elements, the second sole part including all damping elements and the connecting part including all plug connections can be each designed as one-piece formed parts. The material is mostly plastic.

The shoe upper is thereby preferably connected with the first sole part. This delivers improved kinematics at springing of the shoe due to the weight force of the wearer of the shoe.

The shoe upper can be connected with the sole according to a preferred embodiment of the invention by means of a form-fit connection.

According to another embodiment of the invention the bootleg of the shoe, i. e. the shoe upper, and its sole are sewed with another.

A possible design of the proposed solution is the construction of the sole and namely its damping layer which consists at least in the heel region, i. e. in the rear sole region, of two specific layers of damping element as described in WO 03/092423 A1 and to which explicitly reference is made. Thereby, two layers which are arranged on top of each other of said damping elements are connected with another by means of a connection part with lattice-shape structure via a plug-in connection. The cling together of the single parts of the sole occurs preferably exclusive by friction lock connection; an adhesive is preferably not used for that.

The bottom damping element is designed like a cage, i. e. is has preferably a shell-shaped design. The upper damping element is preferably wedged-shaped and lies on the bottom damping element. Both damping elements, thus the upper and the lower layer, are connected with another by the connection part with lattice-shaped structure by means of a plurality of axially aligned pins (first and second plug connectors) which are arranged on opposite sides.

Thereby, the connection part, i. e. the lattice layer, extends mostly along the whole region of the intermediate sole, wherein the upwards directed pins (directed to the foot of the wearer) are present only in the region of the heel wedge in the rear (and central) sole region. In the front sole region (forefoot region) the connection part closes the piston-cylinder-shaped structure of the second damping element to the ground which takes place preferably for example by a saucer-shaped enlargement of the lattice basis above each of the below first damping elements. Thereby, the resting area for the foot and for an additional provided insole respectively is increased and thus the distribution of pressure is improved.

The damping properties of the sole structure can for example be adjusted by different materials and hardness respectively of the single components. A plastic material with a range of hardness between 60 and 95 Shore A is preferred.

At first, it is the advantage of the proposed sole structure that the upper, second sole part is exchangeable so that the possibility is given to adapt said part individually.

Furthermore, it is beneficial that the sole parts which are used have a very good durableness and thus a small tendency to a permanent deformation.

Furthermore it is very beneficial that no gluing of components is necessary.

Furthermore, it is beneficial with regard to recycling that a (at least partial) correctly sorted separation of the single components is possible.

A further and central beneficial property of the proposed shoe and its sole respectively is that by the design of the first plugs, i. e. namely by proper choosing of the length of the same, it is provided that the axial lower end of the first plugs protrudes from the envelop of the bottom side of the sole—what can be the bottom plate or an outer sole which is arranged below the bottom plate—at a sufficient load of the shoe and the sole respectively by the weight or mass force of the wearer and thus fulfils a cleat or stud function. Accordingly, the shoe gets a better hold especially on a lawn which however is only present when respective forces occur. At regular use, at which thus no specifically strong pulsed load peaks occur, the axial ends of the first plugs do not protrude from the envelop, i. e. from the lower surface of the bottom plate and the outsole respectively, so that said cleat effect does not occur and the shoe has the usual classical wearing comfort.

The use of a shoe upper part is possible with and without Strobel sole.

At a shoe upper part with Strobel sole a plugged connection between bootleg (shoe upper) and sole is provided, i. e. the sole is neither glued nor sewed to the bootleg and can be separated from the bootleg at any time. The basis for that is the above mentioned principle of the first and second sole part which are connected with another by the connection part via plug-in connection.

The first sole part with the first damping elements consists thereby preferably of the running surface and an integrated layer of the mentioned first damping elements which layer extends partially or completely along the sole.

The bootleg (i. e. the shoe upper) comprises thereby preferably recesses (holes) in the region of the inner sole which correspond with respect to the distribution and position to the plug connectors (pins) of the plug-in connection of the connection part. The connection part is inserted from the upper side into the bootleg and positioned in the same so that the plug connectors (pins) correspond with the recesses. The respective layer of the damping elements is connected, i. e. pressed in, through the recesses with the plug connectors from the bottom side (below the bootleg). The bootleg it then clamped between the connection part and the first sole part. The second sole part the then inserted into the bootleg from the upper side and plugged on the connection part.

The connection part can also be provided as a substitute for a Strobel sole. This embodiment is similar to that one as explained above, wherein the difference is given that the bootleg has no Strobel sole with recesses (holes) but the Strobel sole is substituted by the connection part (lattice). In this case, the connection part with the respective plug connectors has an additional basis (preferably made of a softer plastic material with a hardness between 65 and 90 Shore A, of leather, of synthetic leather or of textile material) which fills the open spacing of the lattice and forms the underlay for sewing of the bootleg.

This "lattice Strobel sole" is sewed to the bootleg which is open at the bottom side. The first and the second damping element are plugged on from the bottom side and from the inner side respectively.

Generally, at the bottom side of the first damping element and namely at the bottom side of its bottom plate an outer sole can be arranged. For the passage of the first plugs from the bottom side of the outer sole at respective load conditions of course openings in the outer sole are provided which correspond to that one in the bottom plate and preferably flush with the same.

BRIEF DESCRIPTION OF THE DRAWING

In the drawing an embodiment of the invention is shown.

DETAILED DESCRIPTION OF THE INVENTION

Figure 1:
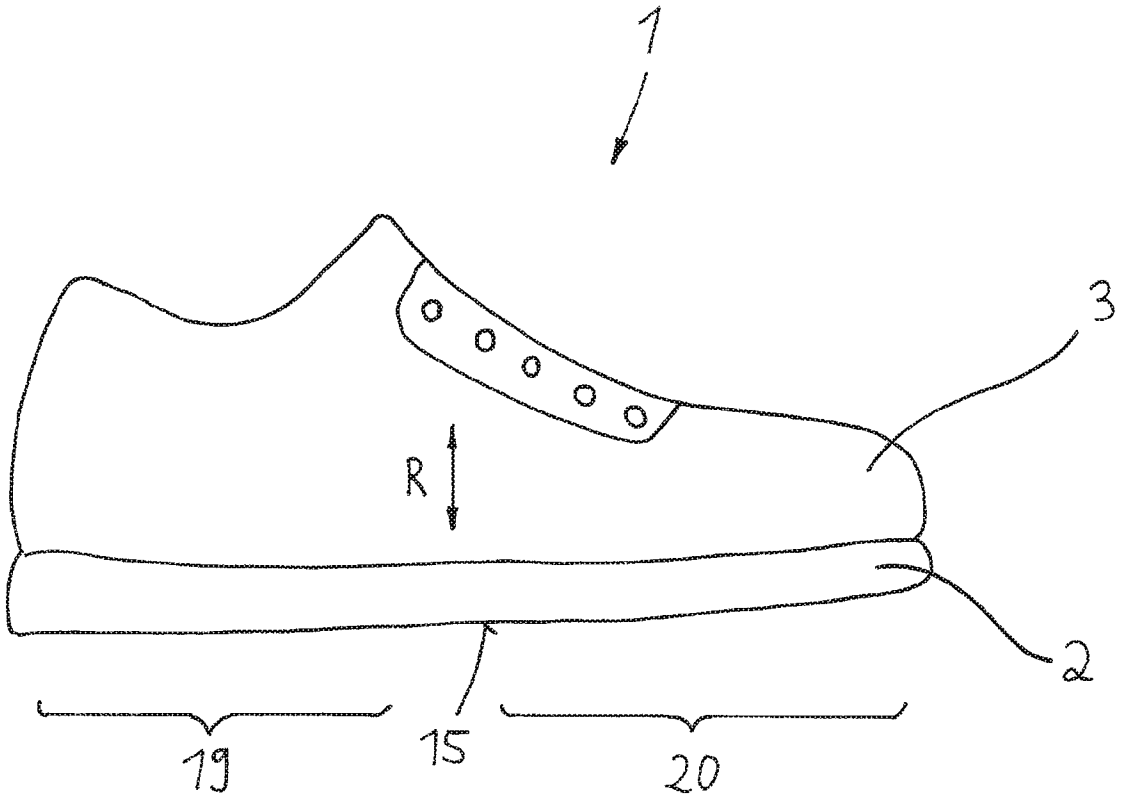
FIG. 1 shows in the side view a sports shoe.

In FIG. 1 a shoe 1 is shown which is a sports shoe and which comprises a shoe upper 3 and a sole 2. The shoe 1 stands during intended use on the ground and is charged by the foot of the wearer. This load is generally the weight of the wearer of the shoe as well as the mass forces which result from respective quick movements of the wearer of the shoe as occurring for example at golf sports. Thereby, a direction of loading R results which corresponds mostly to the vertical direction. Then, in the direction of loading R a respective force F acts (see FIG. 3*b*).

In FIG. 1 a rear sole region 19 and a front sole region 20 is denoted which each extend about one third of the total length of the shoe 1; in between a central sole region is arranged which is not specifically denoted.

Figure 2:
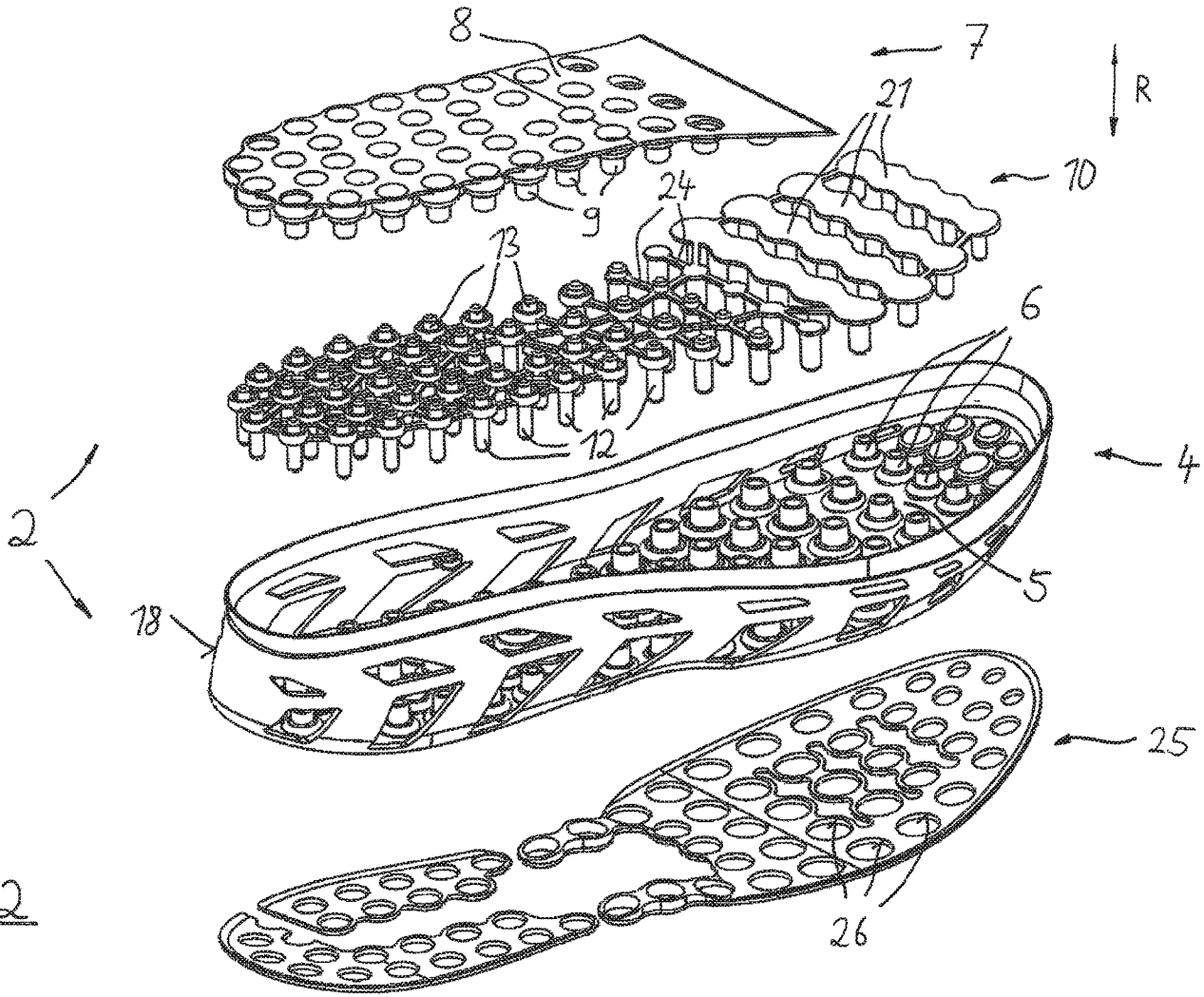
FIG. 2 shows in an exploding view the sole of the sports shoe according to FIG. 1.

From FIGS. 2 and 3 the design of the sole 2 according to the invention can be seen in detail:

The sole has a first, bottom sole part 4 as well as a second, upper sole part 7. Both sole parts 4, 7 are connected with another by a connecting part 10 (details concerning this see below), namely as a plug-in connection and without the use of an adhesive; optionally, also an adhesive can be employed. As can be seen in FIG. 2 the first sole part 4 has an edge 18 which runs in circumferential direction so that this part is shell-shaped.

At the bottom side of the first sole part 4 an outer sole 25 is arranged.

The first sole part 4 as well as the second sole part 7 comprise respective first damping elements 6 and second damping elements 9 respectively. The first damping elements 6 of the first sole part 4 extend from a bottom plate 5 of the first sole part 4 upwards while the second damping elements 9 of the second sole part 7 extend from a cover plate 8 downwards.

The outer sole 25 is connected with the bottom plate 5, especially glued.

The first damping elements 6 as well as the second damping elements 9 are designed as a kind of piston-cylinder damping system. Accordingly it is provided that a hollow section of the damping element with smaller outer dimensions ("piston") enters into a region being designed as hollow body with bigger outer dimensions ("cylinder") and thus develops a damping effect.

With respect to the design of those damping elements reference is made to WO 03/092423 A1 explicitly.

Insofar it should be mentioned that the first damping element 6 as well as the second damping element 9 are designed in the kind of a piston-cylinder unit, wherein a connection section 22 and 23 respectively creates the connection between the "piston" and the "cylinder".

Accordingly the first damping element 6 comprises in its upper region a hollow cylindrical section 16 while the second damping element 9 comprises in its lower region a hollow cylindrical section 17.

The lower first damping element 6 is connected with the upper second damping element 9 via a plug connection 11 which is realized by the connecting part 10. For this, the connecting part 10 comprises a plurality of plug connections 11 which comprise first plugs 12 and second plugs 13 which align in the direction of loading R.

Though the second sole part 7 comprises an extension which covers substantially only the rear sole region 19 and as the case may be also the central sole region; however, the front sole region remains free from the second sole part 7.

It can be seen from FIG. 2 that insofar the second sole part 7 is designed wedge-shaped and covers not completely the connecting part 10 which lies below the same.

So that however for the resting of the foot a well pressure distribution is ensured the connecting part 10 has therefore in its region which is arranged in the front sole region 20 an enlarged saucer-shaped footrest 21.

The connecting part 10 consists of single plug connections 11 with respective lower first plugs 12 and upper second plugs 13, wherein the single plug connections 11 are connected with another via connection rods 24. So a lattice-shaped structure results for the connecting part 10 which can be assembled as a whole.

So the proposed concept is basing according to one aspect on two layers of piston-cylinder-like damping elements which are arranged on top of each other, i. e. in series, wherein the connection of those damping elements which are arranged on top of each other is effected by the connecting part 10.

Here, only a connection via friction engagement and without adhesive is provided. Rather a sticking together of the first and the second sole part occurs by means of the connecting part.

Figures 3A, 3B:
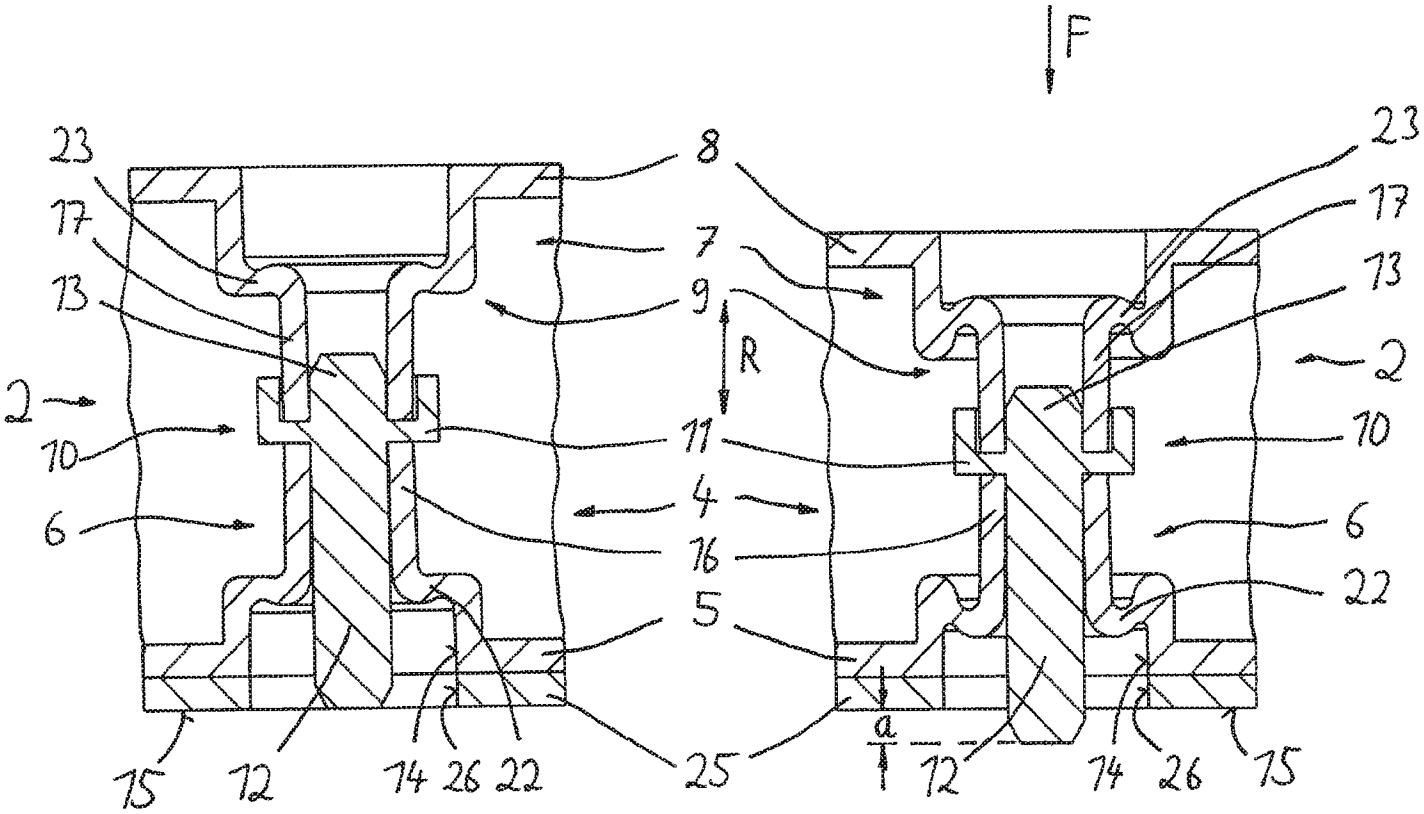
FIG. 3*a* shows a part of the side view of the sole in sectional view, wherein the load-free state is shown.
FIG. 3*b* shows the side view according to FIG. 3*a*, wherein now a weight and/or mass force of the wearer of the shoe is acting onto the sole.

A further substantial aspect of the proposed concept results especially from the FIGS. 3*a* and 3*b*. FIG. 3*a* shows a substantial load-free state of the sole, wherein here also those forces can be subsumed which occur at usual normal load however without specific load peaks. However, in FIG. 3*b* that state is shown where a force F acts on the sole 2 and leads to the depicted deformation. This force F includes as the case may be beside the weight of the wearer of the shoe also the mass forces which occur at quick movements of the wearer of the shoe, for example during execution of a hit with a golf club.

It can be seen that the first plug 12 which is directed downwards is relatively long and can extend through an opening 14 in the bottom plate 5 as well as through a corresponding opening 26 in the outer sole 25 in such a manner that the first plug 12 protrudes from the bottom surface 15 of the sole 2 at the shown deformation of the sole 2 due to the force F according to FIG. 3*b* (compare the depiction of FIG. 3*a* with FIG. 3*b*). The resulting overhang is denoted with a.

So, it results that the shoe and the sole respectively at a corresponding application with a force F provides a cleat or stud sole property, i. e. the axial end of the first plug 12 which protrudes from the envelop (lower surface 15) with overhang a finds a form-closed hold in the ground as far as the same allows the penetration of the plug.

This can for example be used at the execution of a hit with a golf club, i. e. the shoe provides the mentioned property and the improved hold at the ground in that moment, while otherwise this effect does not occur.

Not mandatory, but preferably it is provided that the axial end of the plug 12 flushes with the bottom surface 15 (see FIG. 3*a*) when the shoe is not charged with a load. However, it can be provided that the axial end of the plug 12 is recessed with respect to the bottom surface 15 without outer forces and protrudes beyond the surface 15 only at a respective force F.

At an elastic deformation of the sole 2 the ends of the pins (ends of the first plugs 12) protrude from the surface 15 of the sole in the direction of the ground and can penetrate the ground earth. Such a solution is especially interesting for golf sports. Also, such a solution is of interest to be used for example for soccer, especially on artificial turf.

The embodiment shows the case at which without application of a force F at first a flushing surface between the bottom side of the surface 15 of the sole and the axial end of the first plug 12 is given and then at loading of the sole the axial ends of the first plugs 12 protrude from the surface 15 of the sole in the direction to the ground.

However, it can also be provided, and this is explicitly covered by the present concept according to the invention, that already in the non-loaded state of the shoe and the sole respectively the axial end of the first plug 12 protrudes by a certain amount from the surface 15 and so creates a certain (still small) cleat effect. Then, at charging of the shoe and the sole respectively with the force F the axial ends of the first plugs 12 protrude further from the surface 15 of the sole and intensify the aimed cleat or stud effect. The grip of the sole at the ground is thus intensified respectively at charging with the force F.

If the shoe upper is directly arranged at the first sole part it is beneficial that springing movements of the shoe causes a reduced relative movement between shoe upper part and foot.

Generally, the connection of the shoe upper 3 with the sole 2 can take place in different ways:

The shoe upper 3 can be designed as closed (sock-like) structure which runs around the sole of the foot of the wearer, wherein for example the lower ending is realized by a Strobel sole which is sewed with the shoe upper part. In the Strobel sole openings (cuttings) can be machined which correspond to the position of the plug connectors (i. e. the hole pattern) of the connecting part 10. At the assembly of the sole 2 then the so prepared shoe upper is placed between the single sole parts in such a manner that the Strobel sole and thus the shoe upper 3 is form-fitted connected with the sole 2.

It can also be provided that at the injection moulding process of one of the sole parts a textile material section is placed in the injection moulding tool, wherein said material section forms the Strobel sole and a part of the shoe upper 3 respectively. So, then a firm connection which is produced by the injection moulding process exists between one of the sole parts and the textile material section and thus a connection between sole 2 and shoe upper 3 after the assembly of the sole 2. The mentioned sole part can thereby be especially the connecting part 10 or the second sole part 7.

It can also be provided at the injection of the sole part in the mentioned manner that the textile material is provided before with a respective perforation according to the hole pattern of the pins and is so inserted into the injection moulding tool.

Furthermore, as a variation of this concept it can be provided that the mentioned textile material section which forms the Strobel sole functions quasi as carrier material which is inserted into the injection moulding tool and on which then only the lattice structure is applied by the injection moulding process which is required for the production of the described plug-in connection. Therefore, especially the second sole part 7 can be taken in consideration.

If by the described way the second sole part 7 is provided with the textile material section it can beneficially be done without the use of an inserted sole as the case may be because this function is then realized by the Strobel sole which is produced in that manner. The part which is produced in such a manner is thus used as Strobel sole and comprises the plug-in connections for the described sole.

Beneficially, a very flexible and light composite material results which can be easily sewed.

Beneficially, then it can also be done without a circumferential edge 18 at the first sole part 4.

Thereby, it can also be provided that lacing bandages are a part of the textile material section which is inserted into the injection moulding tool.

With a respective design it can be reached beneficially that again a flexible and light construction is created which can be produced in an easy manner. The basis of the plastic lattice of the sole is here clearly defined, properly designed and well sealed. Furthermore, reinforcements (for example heel caps) can be integrated in an easy manner.

It can also be provided that the above described variations are used in combination insofar as they are each only used in a defined region of the sole (that is for example in the forefoot region, the midfoot region or the heel region). For example the lattice which is required for the plug-in connection is injected only in the forefoot region directly at the Strobel sole while this is not the case in the joint (i. e. midfoot) region; thus the connection of the shoe upper with the sole would take place here only as plug connection (by means of the mentioned hole pattern in the Strobel sole).

It is the benefit of this variation that no plastic areas are present in the shoe and no damping movement takes place in the shoe. Furthermore, the assembly of the shoe and the sole respectively is very easy.

As a further variation of the described concept it can be provided that it is namely done substantially without an edge 18 at or in the first sole part 4 but that however edge regions in the kind of the edge 18 are provided (only) in the region of the tip of the sole and in the region of the heel of the sole.

Preferably the single parts of the sole are made of polyolefin elastomers (e. g. TPE-S, TPU or PA).

Also, as the shoe upper part a knitted material can be provided.

LIST OF REFERENCES

1 Shoe
2 Sole
3 Shoe upper
4 First sole part
5 Bottom plate
6 First damping element
7 Second sole part
8 Cover plate
9 Second damping element
10 Connecting part
11 Plug connection
12 First plug
13 Second plug
14 Opening in the bottom plate
15 Surface (envelope)

16 Hollow-cylindrical section
17 Hollow-cylindrical section
18 Edge
19 Rear sole region
20 Front sole region
21 Footrest
22 Connection section
23 Connection section
24 Connection rod
25 Outer sole
26 Opening in the outer sole
R Direction of loading
F Force (weight)
a Overhang

The invention claimed is:

1. A shoe, which has a sole connected to a shoe upper, wherein the sole comprises:

a first sole part which has a bottom plate, wherein a plurality of first damping elements which extend in a direction of loading is arranged on the bottom plate, wherein the loading is caused by a weight of a wearer and occurs when the shoe is worn by the wearer;

a second sole part which has a cover plate, wherein a plurality of second damping elements which extend in the direction of loading is arranged on the cover plate;

a connecting part which comprises a plurality of plug connections which are connected with one another, wherein each of the plug connections comprises a first plug which extends downwards from a central portion of the each of the plug connections in the direction of loading and a second plug which extends upwards from the central portion of the each of the plug connections in the direction of loading, wherein the first plug is designed to engage in a respective one of the first damping elements and wherein the second plug is designed to engage in a respective one of the second damping elements, wherein at least a portion of the first plugs extend through an opening in the bottom plate, and a deformation of the sole in the direction of loading due to the weight of the wearer when the shoe is worn by the wearer causes the portion of the downwards directed first plugs to protrude from the lower surface of the sole further than when the shoe is not worn by the wearer and the weight of the wearer is not applied, wherein each of the first damping elements is designed as a hollow body and comprises in an upper end region a hollow-cylindrical section and each of the second damping elements is designed as a hollow body and comprises in a lower end region a hollow-cylindrical section, and wherein the first damping elements consist of two partial hollow bodies which are connected with one another by a connection section which extends substantially perpendicular to the direction of loading, one of the partial hollow bodies is formed by the hollow-cylindrical section in the upper region of the damping element, and an outer dimension of an upper partial hollow body of the hollow bodies is smaller than an outer dimension of a bottom partial hollow body of the hollow bodies.

2. The shoe according to claim 1, wherein the first damping elements and the bottom plate are formed as a one piece part, or the second damping elements and the cover plate are formed as a one piece part.

3. The shoe according to claim 1, wherein the first plug is designed to frictionally engage into the hollow-cylindrical section of the first damping element, or the second plug is designed to frictionally engage into the hollow-cylindrical section of the second damping element.

4. The shoe according to claim 1, wherein the first plug and an inner diameter of the hollow-cylindrical section of the first damping element are tolerated to one another in such a manner that in a mounted state the first plug and the hollow-cylindrical section are arranged to one another with press fit, or the second plug and an inner diameter of the hollow-cylindrical section of the second damping element are tolerated to one another in such a manner that in the mounted stake the second plug and the hollow-cylindrical section are arranged to one another with press fit.

5. The shoe according to claim 1, wherein the first sole part is surrounded by an edge which extends laterally upwards.

6. The shoe according to claim 1, wherein the second sole part covers a rear sole region of the sole and does not cover a front sole region of the sole.

7. The shoe according to claim 6, wherein the plug connections of the connection part are disposed only in a region of the connection part that is covered by the second sole part.

8. The shoe according to claim 1, wherein the connecting part comprises at least one flat footrest.

9. The shoe according to claim 1, wherein the second damping elements consist of the two partial hollow bodies which are connected with one another by a connection section which extends substantially perpendicular to the direction of loading, wherein one of the partial hollow bodies is formed by the hollow-cylindrical section in the lower region of the damping element, wherein the outer dimension of the lower partial hollow body is smaller than the outer dimension of the upper partial hollow body.

10. The shoe according to claim 1, wherein the plug connections of the connecting part are connected with one another by a plurality of bar-shaped or rod-shaped connection rods, wherein especially two adjacent plug connections of the connecting part are connected with each one connection rod.

11. The shoe according to claim 1, wherein the first sole part and the plurality of first damping elements are formed as a first one piece part, the second sole part and the plurality of second damping elements are formed as a second one piece part, and the connecting part and the plurality of plug connections are formed as a third one-piece part.

12. The shoe according to claim 1, wherein the shoe upper is connected with the first sole part.

13. The shoe according to claim 1, wherein the shoe upper is connected with the sole by means of a form-fit connection.

14. The shoe according to claim 1, wherein the first damping elements and the bottom plate are formed as a one piece part and the second damping elements and the cover plate are formed as a one piece part.

15. The shoe according to claim 1, wherein the first plug is designed to frictionally engage into the hollow-cylindrical section of the first damping element, and the second plug is designed to frictionally engage into the hollow-cylindrical section of the second damping element.

16. The shoe according to claim 1, wherein the first plug and an inner diameter of the hollow-cylindrical section of the first damping element are tolerated to one another in such a manner that in a mounted state the first plug and the hollow-cylindrical section are arranged to one another with press fit, and the second plug and an inner diameter of the hollow-cylindrical section of the second damping element are tolerated to one another in such a manner that in the mounted state the second plug and the hollow-cylindrical section are arranged to one another with press fit.

17. A shoe, which has a sole connected to a shoe upper, wherein the sole comprises:

a first sole part which has a bottom plate, wherein a plurality of first damping elements which extend in a direction of loading is arranged on the bottom plate, wherein the loading is caused by a weight of a wearer and occurs when the shoe is worn by the wearer;

a second sole part which has a cover plate, wherein a plurality of second damping elements which extend in the direction of loading is arranged on the cover plate;

a connecting part which comprises a plurality of plug connections which are connected with one another, wherein each of the plug connections comprises a first plug which extends downwards from a central portion of the each of the plug connections in the direction of loading and a second plug which extends upwards from the central portion of the each of the plug connections in the direction of loading, wherein the first plug is designed to engage in a respective one of the first damping elements and wherein the second plug is designed to engage in a respective one of the second damping elements, wherein at least a portion of the first plugs extend through an opening in the bottom plate, and a deformation of the sole in the direction of loading due to the weight of the wearer when the shoe is worn by the wearer causes the portion of the downwards directed first plugs to protrude from the lower surface of the sole further than when the shoe is not worn by the wearer and the weight of the wearer is not applied, wherein each of the first damping elements is designed as a hollow body and comprises in an upper end region a hollow-cylindrical section and each of the second damping elements is designed as a hollow body and comprises in a lower end region a hollow-cylindrical section, and wherein the second damping elements consist of two partial hollow bodies which are connected with one another by a connection section which extends substantially perpendicular to the direction of loading, one of the partial hollow bodies is formed by the hollow-cylindrical section in the lower region of the damping element, and the outer dimension of the lower partial hollow body is smaller than the outer dimension of the upper partial hollow body.

18. The shoe according to claim 17, wherein the first damping elements and the bottom plate are formed as a one piece part, or the second damping elements and the cover plate are formed as a one piece part.

19. The shoe according to claim 17, wherein the first plug is designed to frictionally engage into the hollow-cylindrical section of the first damping element, or the second plug is designed to frictionally engage into the hollow-cylindrical section of the second damping element.

20. The shoe according to claim 17, wherein the first plug and an inner diameter of the hollow-cylindrical section of the first damping element are tolerated to one another in such a manner that in a mounted state the first plug and the hollow-cylindrical section are arranged to one another with press fit, or the second plug and an inner diameter of the hollow-cylindrical section of the second damping element are tolerated to one another in such a manner that in the mounted state the second plug and the hollow-cylindrical section are arranged to one another with press fit.

21. The shoe according to claim 17, wherein the first sole part is surrounded by an edge which extends laterally upwards.

22. The shoe according to claim 17, wherein the second sole part covers a rear sole region of the sole and does not cover a front sole region of the sole.

23. The shoe according to claim 22, wherein the plug connections of the connection part are disposed only in a region of the connection part that is covered by the second sole part.

24. The shoe according to claim 17, wherein the connecting part comprises at least one flat footrest.

25. The shoe according to claim 17, wherein the plug connections of the connecting part are connected with one another by a plurality of bar-shaped or rod-shaped connection rods, wherein especially two adjacent plug connections of the connecting part are connected with each one connection rod.

26. The shoe according to claim 17, wherein the first sole part and the plurality of first damping elements are formed as a first one piece part, the second sole part and the plurality of second damping elements are formed as a second one piece part, and the connecting part and the plurality of plug connections are formed as a third one-piece part.

27. The shoe according to claim 17, wherein the shoe upper is connected with the first sole part.

28. The shoe according to claim 17, wherein the shoe upper is connected with the sole by means of a form-fit connection.

29. The shoe according to claim 17, wherein the first damping elements and the bottom plate are formed as a one piece part and the second damping elements and the cover plate are formed as a one piece part.

30. The shoe according to claim 17, wherein the first plug is designed to frictionally engage into the hollow-cylindrical section of the first damping element, and the second plug is designed to frictionally engage into the hollow-cylindrical section of the second damping element.

31. The shoe according to claim 17, wherein the first plug and an inner diameter of the hollow-cylindrical section of the first damping element are tolerated to one another in such a manner that in a mounted state the first plug and the hollow-cylindrical section are arranged to one another with press fit, and the second plug and an inner diameter of the hollow-cylindrical section of the second damping element are tolerated to one another in such a manner that in the mounted state the second plug and the hollow-cylindrical section are arranged to one another with press fit.

* * * * *